US005626489A

United States Patent [19]

Marshall et al.

[11] Patent Number: 5,626,489

[45] Date of Patent: May 6, 1997

[54] SEALED ELECTRICAL CONNECTOR ASSEMBLY

[75] Inventors: Robert C. Marshall; James R. Pelletier, both of St. Petersburg, Fla.

[73] Assignee: Molex Incorporated, Lisle, Ill.

[21] Appl. No.: 421,335

[22] Filed: Apr. 13, 1995

[51] Int. Cl.[6] ..... H01R 11/20

[52] U.S. Cl. ..... 439/402; 439/523

[58] Field of Search ..... 439/271, 389, 439/391, 395, 402, 404, 521, 523, 367

[56] References Cited

U.S. PATENT DOCUMENTS

| | | | |
|---|---|---|---|
| 3,791,514 | 2/1974 | Watanabe | 220/307 X |
| 3,793,612 | 2/1974 | Driscoll | 439/402 |
| 3,936,128 | 2/1976 | D'Annessa et al. | 439/399 |
| 4,444,448 | 4/1984 | Silbernagel et al. | 339/98 |
| 4,525,019 | 6/1985 | Brasky | 439/142 |
| 4,830,631 | 5/1989 | Hsueh | 439/622 |
| 4,874,325 | 10/1989 | Bensing et al. | 439/272 |
| 4,891,018 | 1/1990 | Afflerbaugh et al. | 439/402 |
| 4,954,098 | 9/1990 | Hollingworth et al. | 439/404 |
| 5,132,494 | 7/1992 | Burton et al. | 439/447 X |
| 5,266,045 | 11/1993 | Yamamoto et al. | 439/275 |
| 5,431,758 | 7/1995 | Delalle | 439/523 |
| 5,435,738 | 7/1995 | Isohata | 439/271 X |

FOREIGN PATENT DOCUMENTS

| | | |
|---|---|---|
| 0091770 | 10/1983 | European Pat. Off. . |
| 3540831 | 11/1984 | Germany . |
| 4414533 | 4/1993 | Germany . |
| 6196210 | 7/1994 | Japan . |

OTHER PUBLICATIONS

American Marking Corporation, "Direct Barrel Splice" Date Sheet p. 7.

Ideal Industries "Twister DB Plus" Data Sheet.

King Technologies "One Step" Data Sheet.

3M Corporation Wire Connectors Section, pp. 13, 15, & 17.

*Primary Examiner*—Allan N. Shoap

*Assistant Examiner*—Christopher J. McDonald

*Attorney, Agent, or Firm*—Stacey E. Caldwell

[57] ABSTRACT

A sealed connector assembly is provided for interconnecting two or more electrical wires. A dual-durometer body includes a relatively rigid plug portion and a relatively resilient sealing portion, with corresponding channels in the portions for receiving the wires. A conductive contact element is mounted on the resilient plug portion of the body and is adapted to electrically interconnect the wires. A relatively resilient sealing cover is adapted to telescope with the body and to seal the rigid plug portion and the contact element. The body and cover have complementary interengaging convolutions to retain the body and cover in an interengaged sealed condition.

17 Claims, 2 Drawing Sheets

SEALED ELECTRICAL CONNECTOR ASSEMBLY

FIELD OF THE INVENTION

This invention generally relates to the art of electrical connectors and, particularly, to a sealed electrical connector assembly of the insulation displacement type.

BACKGROUND OF THE INVENTION

Electrical connectors are used in a wide variety of applications, including applications wherein the connector must be sealed from the environment or the surroundings within which the connector is used. In fact, some connectors must be waterproof in order to seal and protect the interior components of the connector. For instance, waterproof connectors are used in underground applications such as in conjunction with irrigation valves. Waterproof or sealed connectors also are used in controls, pumps and the like for marine applications. Environmentally sealed connectors also are widely used in automotive or other vehicular applications.

A type of sealed or waterproof connector for terminating electrical wires is called a splice or tap connector. Such connectors often require the wire ends to be pushed into openings in one end of the connector until they are properly positioned within the connector. The wires are then forced into interengagement with a contact element which electrically interconnects or splices the wires together.

Still further, splice or tap connectors often are provided as insulation displacement connectors. Insulation displacement connectors are used to interconnect electrical wires which have conductors surrounded by an outer insulating layer. The conductive contact element of the connector is effective to cut through the insulating layers of the wires and make contact with the central conductors of the wires without stripping the insulating layer from the wires or crimping a terminal to the bare wire.

Heretofore, a typical sealed connector of the character described, particularly a waterproof connector, fills an internal space of the connector housing with a waterproof grease or gel to make the connector impervious to the ingress of moisture. Problems have been encountered with these types of connectors because the waterproof greases or gels can wash out of a connector over time, and the connector, thereby, loses its sealing capabilities. Furthermore, secondary filling operations may be time-consuming and expensive, adding to the cost of an otherwise simple and inexpensive connector.

The present invention is directed to solving these problems and providing a very simple but very effective sealed electrical connector, particularly a connector of the insulation displacement type.

SUMMARY OF THE INVENTION

An object, therefore, of the invention is to provide a new and improved sealed electrical connector assembly for interconnecting two or more electrical wires. The connector assembly may be of the insulation displacement type for interconnecting two or more insulated electrical wires.

In the exemplary embodiment of the invention, the connector assembly includes a dual-durometer body having a relatively rigid plug portion and a relatively resilient or pliable sealing portion with corresponding channels in the portions for receiving the wires. A conductive contact element is movably mounted within the rigid plug portion of the body and is adapted to displace the insulating layer and electrically interconnect the wires. A relatively resilient or pliable sealing cover is adapted to telescope with the body and to cover the rigid plug portion and the contact element. The body and cover have complementary interengaging latching seal means to retain the body and cover in an interengaged sealed condition.

As disclosed herein, the rigid plug portion of the body includes a slot intersecting the channels and adapted for movably mounting the contact element. The resilient sealing portion of the body includes sealing means in the form of flexible ribs or convolutions integral with the resilient portion and embracing the wires. The rigid plug portion is fabricated of a relatively high durometer thermoplastic material, and the resilient sealing portion is fabricated of a relatively low durometer thermoplastic material. The complementary interengaging latching seal means between the body and cover are formed by interengaging convolutions.

Another feature of the invention contemplates the provision of tethering means interconnecting the sealing cover with the sealing portion of the body. In addition, the cover, the sealing portion of the body and the tethering means may all be integrally fabricated of the low durometer thermoplastic material.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
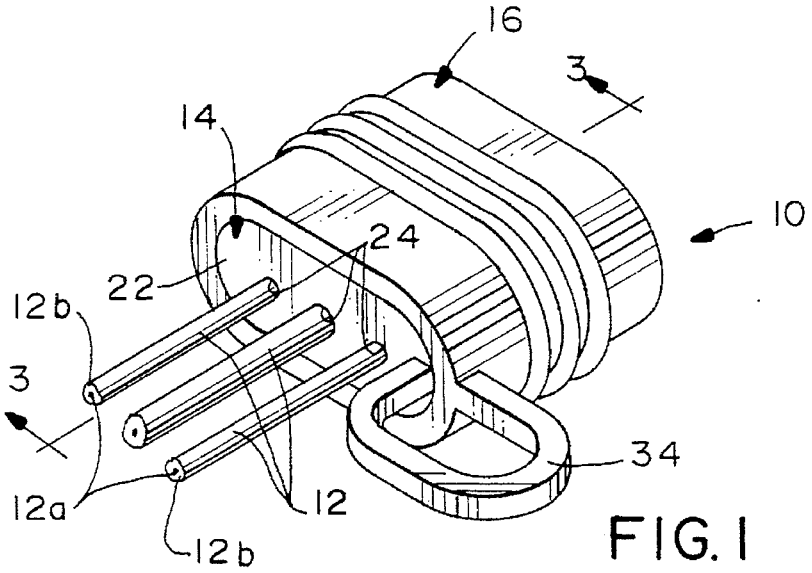
FIG. 1 is a perspective view of a sealed electrical connector assembly embodying the concepts of the invention, with the cover fully assembled to the body.
Figure 2:
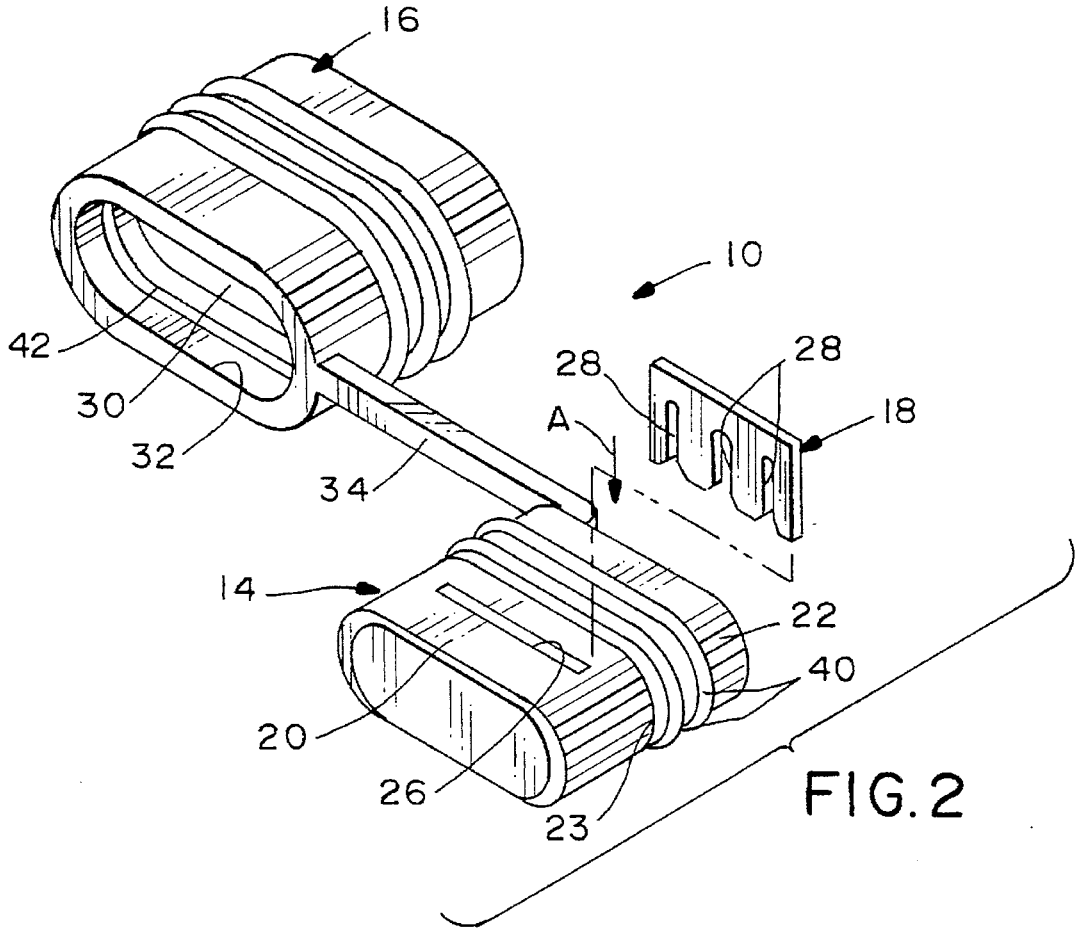
FIG. 2 is an exploded perspective view of the connector assembly, with the contact element removed from the body and the cover disassembled from the body.

Referring to the drawings in greater detail, and first to FIGS. 1 and 2, the invention is directed to a sealed insulation displacement connector assembly, generally designated 10, for interconnecting two or more insulated electrical wires 12. As shown, the specific connector is adapted for interconnecting three electrical wires. Each wire includes a central conductor 12*a* surrounded by an outer insulating layer or cladding 12*b*. Connector assembly 10 is of a very simple and inexpensive construction and, generally, includes three main parts, namely: a dual-durometer body, generally designated 14; a relatively resilient sealing cover, generally designated 16; and a plate-like conductive contact element, generally designated 18.

More particularly, dual-durometer body 14 of connector assembly 10 includes a relatively rigid plug portion 20 and a relatively resilient or pliable sealing portion 22. Rigid plug portion 20 is fabricated of a relatively high durometer thermoplastic material and resilient sealing portion 22 is fabricated of a relatively low durometer thermoplastic material. In fabrication, the plug portion can be molded first, with the sealing portion subsequently insert-molded to the plug portion to form a unitary dual-durometer body. Alternatively, the plug portion can be adhesively fixed or otherwise joined to the sealing portion at an interface 23. Wire-receiving passages or channels 24 are formed into the body, as will be more clearly seen hereinafter.

Conductive contact element 18 of connector assembly 10 is movably mounted on rigid plug portion 20 of body 14 by inserting the contact element into a slot 26 (FIG. 2) in the direction of arrow "A". The contact element is plate-like and includes three notches or slots 28 which cut through insulation 12*b* of wires 12 so that the sides of the notches electrically engage central conductors 12*a* of the wires to interconnect or splice the wires together.

Sealing cover 16 of connector assembly 10 is adapted to telescope with body 14 and to cover plug portion 20 of the body and contact element 18. The cover is in the form of a cap and defines an internal, closed cavity 30 (FIG. 2) for receiving the body, with a mouth 32 communicating with the cavity for inserting the body thereinto. Cover 16 is tethered to body 14 by a tethering cord 34 integral with and joining the cover and the sealing portion of the body. In fabrication, the cover, resilient portion 22 of the body and the tethering cord all are integrally fabricated or molded of the low durometer thermoplastic material.

Figure 4:
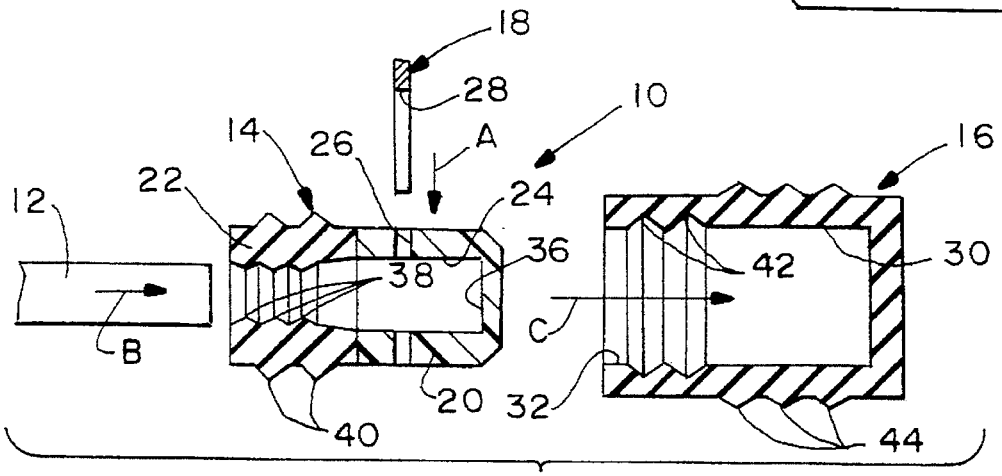
FIG. 4 is an exploded vertical section of the components as depicted in FIG. 3.
Figure 3:
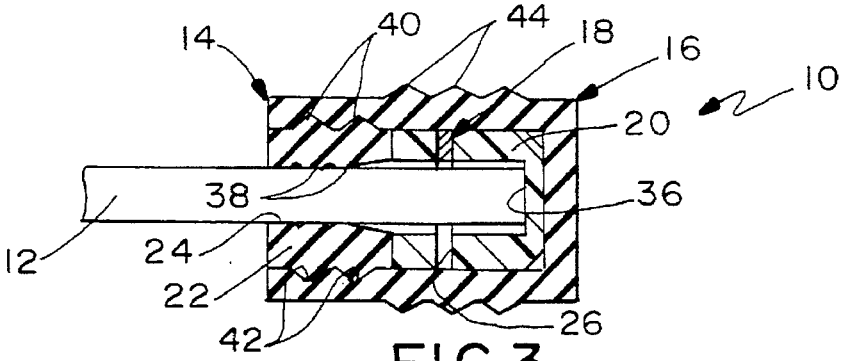
FIG. 3 is a vertical section taken generally along line 3—3 of FIG. 1.

Referring to FIGS. 3 and 4 in conjunction with FIGS. 1 and 2, it can be seen that wires 12 are inserted into channels 24 until the wires abut against an internal surface 36 of rigid plug portion 20 of body 14. It also can be seen how slot 26 in the rigid plug portion of the body intersects the channels so that conductive contact element 18 can be moved to displace the insulation of the wires and interconnect or splice the wires together.

Generally, sealing portion 22 of body 14 includes sealing means in channels 24 for embracing or partially engaging wires 12. In particular, the sealing means are defined by flexible ribs or convolutions 38 molded on an internal surface of the channels and molded integrally with the resilient portion of the body. The ribs resiliently surround the wires and seal the wires and the interior of the connector from the environment.

As seen most clearly in FIG. 4, body 14 and cover 16 have complementary interengaging latching seal means to retain the body and cover in an interengaged sealed condition. In particular, ribs or convolutions 40 are molded integrally with the outside of resilient sealing portion 22 of body 14, and grooves 42 are molded integrally on the inside of resilient cover 16. After wires 12 are inserted into channels 24 of body 14 in the direction of arrow "B" (FIG. 4), and contact element 18 interconnects the wires by movement in the direction of arrow "A" this subassembly is inserted into resilient cover 16 in the direction of arrow "C" (FIG. 4).

The fully assembled connector is shown in FIG. 3 wherein it can be seen that ribs or convolutions 40 about the outside of resilient sealing portion 22 of the body are seated in corresponding grooves or convolutions 42 on the inside of the cover. The cover should be dimensioned to allow ready insertion of the body, and at the same time to provide a good seal between ribs 40 and grooves 42. This convoluted rib-and-groove construction not only provides a seal means but also provides a complementary interengaging latching means to retain the body and cover in an interengaged sealed condition as shown in FIGS. 1 and 3. outwardly projecting ribs 44 also may be molded integrally with cover 16 to facilitate gripping the resilient cover and assembling the connector.

Figure 5:
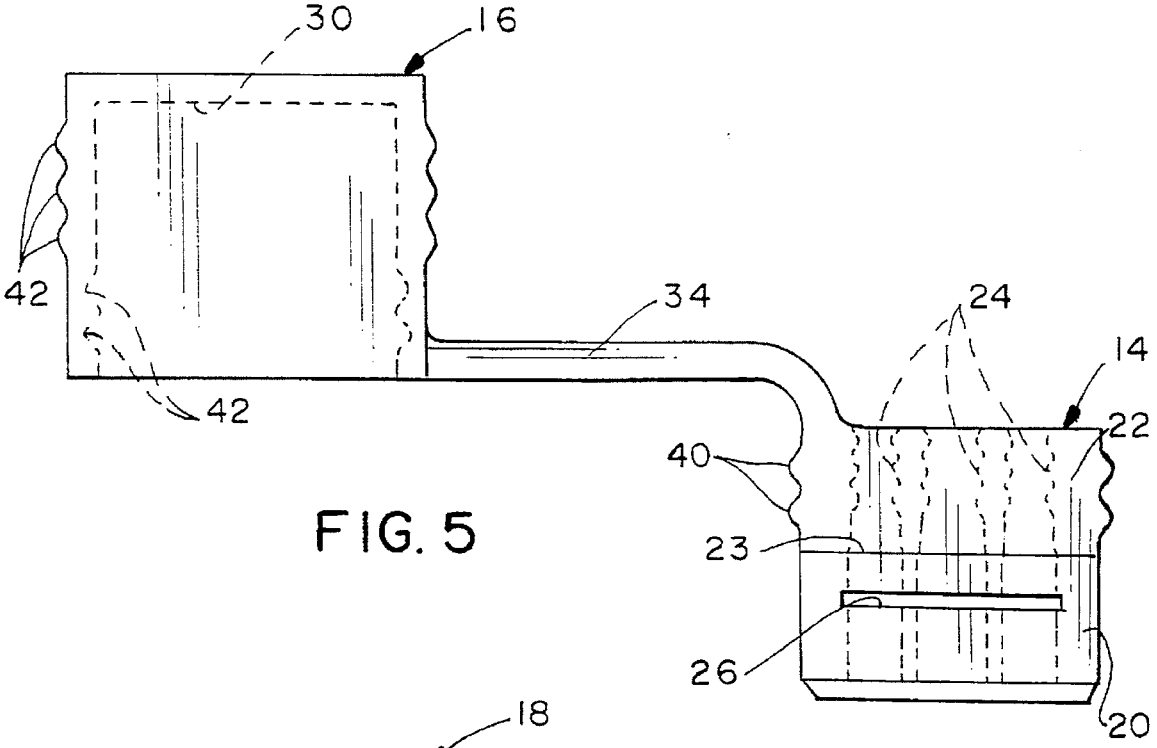
FIG. 5 is a top plan view of the disassembled body and cover, showing a clear illustration of the tethering means therefor.

Lastly, FIG. 5 shows how cover 16 is joined to resilient sealing portion 22 of body 14 by tethering cord 34. As stated above, rigid plug portion 20 of the body first is fabricated, as by molding, and then the relatively resilient sealing portion 22 of the dual-durometer body is insert-molded or otherwise joined to the relatively rigid plug portion. However, with cover 16 joined to the resilient sealing portion of the body by tethering cord 34, the entire subassembly of the cover, the tethering cord and the resilient sealing portion can be insert-molded or joined to the rigid plug portion of the body in a simple, cost effective singular operation. The only remaining assembly step is to insert the conductive (metal) contact element 18 into slot 26 in the rigid portion of the body, and the connector assembly is then ready to receive and splice wires 12. The assembly and termination steps thus afforded by connector assembly 10 are remarkably simple.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A sealed insulation displacement connector assembly for interconnecting two or more insulated electrical wires, comprising:

a dual-durometer body including a relatively rigid portion and a relatively resilient portion with channels extending through both portions of the body for receiving the wires;

a conductive contact element movably mounted on the rigid portion of the body and adapted to displace the insulation and electrically interconnect the wires;

a relatively resilient cover adapted to telescope with the body and enclose the body substantially entirely around its periphery, wherein said cover includes an internal cavity for receiving the body with a mouth communicating with the cavity for inserting bony thereinto, wherein the cover surrounds substantially the entire body except for a portion of the body exposed at the mouth; and said body and cover having complementary interengaging latching means for retaining the body and cover in an interengaged sealed condition.

2. The connector assembly of claim 1 wherein said rigid portion of the body includes a slot intersecting the channels and adapted for mounting a single planar contact element.

3. The connector assembly of claim 1 wherein said resilient portion of the body includes means in the channels for sealing and embracing the wires.

4. The connector assembly of claim 3 wherein said means for sealing and embracing the wires comprise flexible ribs integral with the resilient portion of the body.

5. The connector assembly of claim 1 wherein said complementary interengaging latching means for retaining the body and cover comprise a rib on one of the body and cover and an interengaging groove on the other of the body and cover.

6. The connector assembly of claim 1, including tethering means for interconnecting the cover with the resilient portion of the body.

7. The connector assembly of claim 6 wherein said cover, said resilient portion of said body and said tethering means all are integrally fabricated of a low durometer thermoplastic material.

8. A sealed connector assembly for interconnecting two or more wires, comprising:

a dual-durometer body including a relatively high durometer rigid portion and a relatively low durometer resilient portion with channels in the portions for receiving the wires;

a conductive contact element mounted on the rigid portion of the body and adapted to interconnect the wires;

a relatively resilient cover adapted to telescope over the body and surround the body contiguously around its periphery, wherein said cover includes an internal cavity for receiving the body with a mouth communicating with the cavity for inserting the body thereinto, wherein the cover surrounds substantially the entire body except for a portion of the body exposed at the mouth; and said body and cover having complementary interengaging convoluted means for retaining the body and cover in an interengaged sealed condition.

9. The connector assembly of claim 8 wherein said low durometer portion of the body includes sealing means in the form of integral flexible convolutions for sealing and embracing the wires.

10. The connector assembly of claim 8 wherein said complementary interengaging convoluted means for retaining the body and cover comprise a rib on one of the body and cover and an interengaging groove on the other of the body and cover.

11. The connector assembly of claim 8, including tethering means for interconnecting the cover with the resilient portion of the body.

12. The connector assembly of claim 11 wherein said cover, the resilient portion of said body and said tethering means all are integrally fabricated.

13. A sealed connector assembly for interconnecting two or more wires, comprising:

a dual-durometer body including a relatively rigid portion and a relatively resilient portion with at least two channels in the portions for receiving the wires;

a conductive contact element mounted on the rigid portion of the body and adapted to interconnect the wires;

a cover adapted to telescope with the body and extend substantially entirely around the periphery thereof, wherein said cover includes an internal cavity for receiving the body with a mouth communicating with the cavity for inserting the body thereinto, wherein the cover surrounds substantially the entire body except for a portion of the body exposed at the mouth; and convoluted seal means between the relatively resilient portion of the body and the cover for retaining and sealing the body and contact element within the cover.

14. The connector assembly of claim 13 wherein said resilient portion of the body includes sealing means in the channels for embracing the wires.

15. The connector assembly of claim 14 wherein said sealing means for embracing the wires comprise flexible convolutions within the channels integral with the resilient portion of the body.

16. The connector assembly of claim 13, including tethering means for interconnecting the cover and the resilient portion of the body.

17. The connector assembly of claim 16 wherein said cover, the resilient portion of said body and said tethering means all are integrally fabricated of a relatively low durometer thermoplastic material.

* * * * *